US005127711A

United States Patent [19]

Cass

[11] Patent Number: 5,127,711

[45] Date of Patent: Jul. 7, 1992

[54] HOPPER AND HOOD COMBINATION FOR TUNNELING MACHINE AND TUNNELING MACHINE HAVING THE SAME

[75] Inventor: David T. Cass, Seattle, Wash.

[73] Assignee: The Robbins Company, Kent, Wash.

[21] Appl. No.: 681,980

[22] Filed: Apr. 8, 1991

[51] Int. Cl.[5] ..... E21D 9/12

[52] U.S. Cl. ..... 299/56; 299/68; 405/138

[58] Field of Search ..... 299/31, 33, 56, 58, 299/68; 405/138

[56] References Cited

U.S. PATENT DOCUMENTS

| | | | |
|---|---|---|---|
| 3,378,305 | 4/1968 | Geldmacher et al. | 299/33 |
| 3,382,002 | 5/1968 | Tabor | 299/33 |
| 3,667,808 | 6/1972 | Tabor | 299/33 |
| 3,672,726 | 6/1972 | House | 299/31 |
| 3,961,825 | 6/1976 | Lovat | 299/33 |
| 4,165,129 | 8/1979 | Sugimoto et al. | 299/11 |
| 4,406,498 | 6/1983 | Akesaka | 299/11 |
| 4,456,305 | 6/1984 | Yoshikawa | 299/33 |
| 4,607,889 | 8/1986 | Hagimoto et al. | 299/33 |
| 4,629,255 | 12/1986 | Babendererde | 299/33 |
| 4,630,869 | 12/1986 | Akesaka et al. | 299/33 |
| 4,732,427 | 3/1988 | Lovat | 299/33 |
| 4,774,470 | 9/1988 | Takigawa et al. | 299/1 X |
| 4,818,026 | 4/1989 | Yamazaki et al. | 299/56 |
| 4,844,656 | 7/1989 | Babendererde et al. | 405/144 |
| 4,848,963 | 7/1989 | Babendererde et al. | 405/144 |
| 4,881,862 | 11/1989 | Dick | 414/218 |

FOREIGN PATENT DOCUMENTS

| | | | |
|---|---|---|---|
| 194721 | 5/1967 | U.S.S.R. | 299/56 |
| 1083322 | 9/1967 | United Kingdom . | |

*Primary Examiner*—David J. Bagnell

*Attorney, Agent, or Firm*—Graybeal Jackson Haley & Johnson

[57] ABSTRACT

A hopper and hood combination for muck transfer in a tunneling machine, and a tunneling machine having the same, in which a muck collar is mounted to a cutterhead support and projects into a rotatable cutterhead. A muck chute on the muck collar feeds earth to an earth conveyer when the muck collar and muck chute are in a hopper orientation. The muck chute and muck collar are rotatable relative to the earth conveyor to a hood orientation in which the muck chute restricts earth flow to the earth conveyor. Rotation of the hopper/hood from one orientation to the other is by brief interconnection thereof to the cutterhead without any necessity for any disassembly or reconstruction of the tunneling machine.

16 Claims, 3 Drawing Sheets

HOPPER AND HOOD COMBINATION FOR TUNNELING MACHINE AND TUNNELING MACHINE HAVING THE SAME

BACKGROUND OF THE INVENTION

This invention pertains to earth tunneling machines. Specifically, this invention relates to a hopper and hood combination for shield-type tunneling machines, and to shield-type tunneling machines employing the same.

Earth tunneling machines typically have a rotatable cutterhead attached to a cutterhead support. The cutterhead is commonly equipped with drag teeth and roller cutters and has apertures on its face. As the cutterhead rotates, the teeth loosen earth, which passes through the apertures into an interior earth collecting chamber of the cutterhead where an earth conveyor means removes the accumulated earth.

A problem exists when the tunneling machine moves through soft earth, known as flowing muck, because this muck floods the interior chamber of the cutterhead, making cutterhead rotation and forward movement difficult. Additionally, an excess of flowing muck entering and passing through the cutterhead can cause the face of the tunnel and the surrounding earth to collapse. It is thus necessary to control and limit the flow of the muck to the cutterhead interior chamber.

Proposed solutions to the problems associated with tunneling through flowing muck, once it is encountered, include the attachment of flow limiters to the cutterhead and the associated interior chamber. However, the tunneling machine must be retracted from the tunnel and partially disassembled in order to attach these muck flow limiters.

Another solution to flowing muck tunneling is disclosed in U.S. Pat. No. 4,732,427 issued to Lovat. In the Lovat tunneler, the cutterhead has a muck ring that receives loose earth from the cutterhead through pivotally movable, closable doors. Under flowing muck conditions, the doors seal the muck ring from the cutterhead in response to earth pressure changes within the cutterhead.

However, none of the devices currently known in the art limit muck flow during flowing muck tunneling with a hood apparatus that can also be employed as well to tunnel through hard earth, known as dry muck, by functioning as a hopper to channel earth to the earth conveyor. Additionally, none of the devices for the purpose currently employed discloses a dual position hopper/hood apparatus that is usable in both positions with minimal tunneling machine disassembly.

SUMMARY OF THE INVENTION

The present invention provides a hopper and hood muck receiving combination for a tunneling machine and a tunneling machine having the same. A muck collar is attached to a cutterhead support and projects into the interior earth collecting chamber of a rotatable cutterhead. A muck chute on the muck collar feeds earth in the cutterhead interior earth collecting chamber to an earth conveyor when the muck collar and muck chute are in a hopper position adjacent to the earth conveyor. Relative rotation of the muck collar and muck chute to a hood position remote from the earth conveyor restricts earth flow to the earth conveyor; and thus by back pressure tends to support the work face from collapse.

In a preferred embodiment of the present invention, the muck collar is arcuate-shaped and is axially oriented with respect to the cutterhead, the earth conveyor is an auger, and the muck chute is a plate on an end of the muck collar that is pitched at an angle from horizontal. Additionally, the plate has a cross-section tangential to the circumference of the auger, and the plate edge is adjacent to the auger when the muck collar and muck chute are in the hopper position.

In another aspect of the preferred embodiment, the muck collar and muck chute are locked to the cutterhead support in a tunneling mode, most preferably by a lock pin. Additionally, the muck collar and muck chute are locked to the cutterhead in a repositioning mode, most preferably by a remote control actuated lock pin, for movement of the muck collar and muck chute between the hopper position and the hood position by rotation of the cutterhead relative to the cutterhead support.

BRIEF DESCRIPTION OF THE DRAWINGS

These and other features of the present invention will be more fully appreciated when considered in light of the following specification and drawings in which.

DETAILED DESCRIPTION OF THE PREFERRED EMBODIMENT

Figure 1:
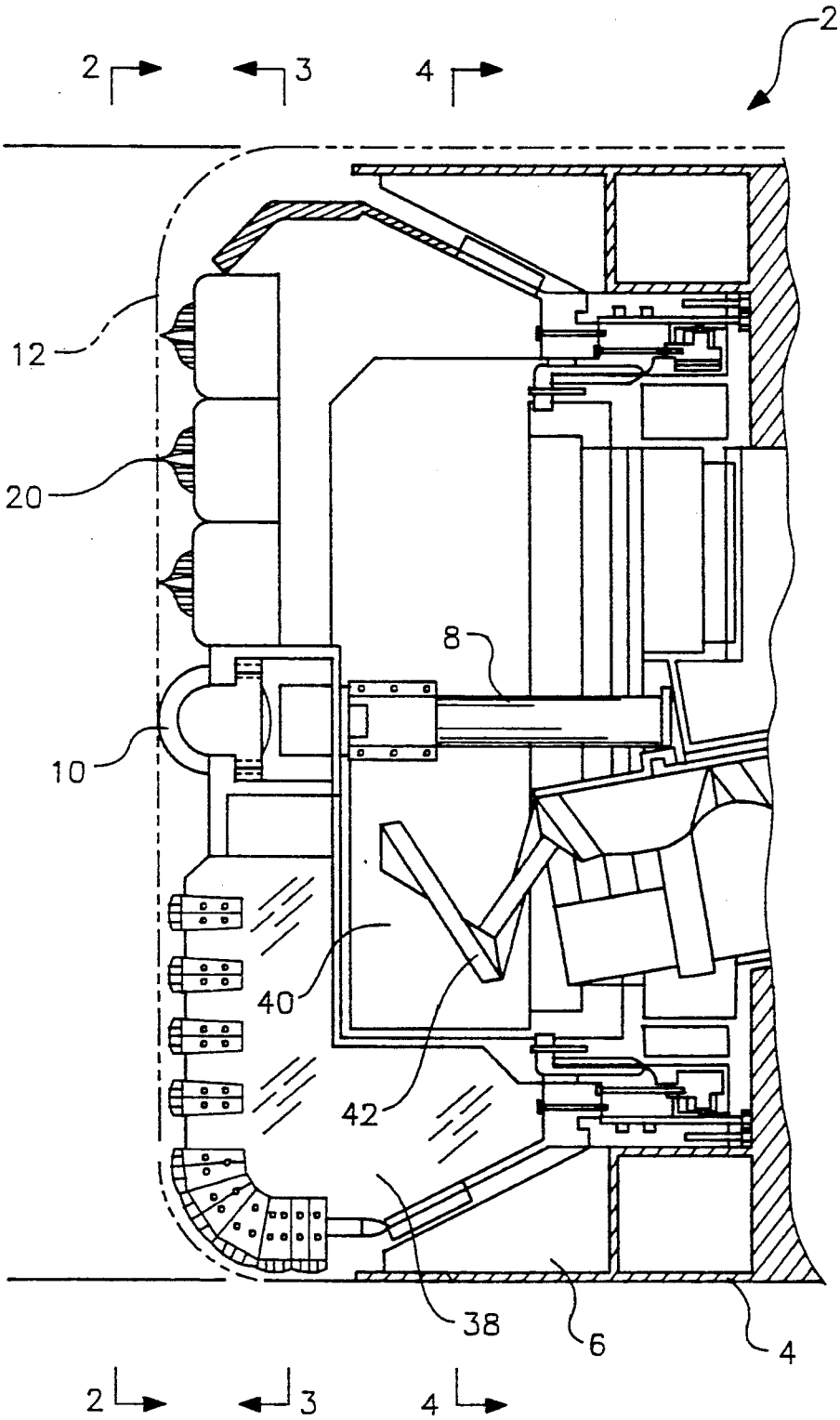
FIG. 1 is a cross-sectional view of a tunneling machine, cutterhead, and hopper and hood combination embodying the present invention.

The present invention is a rotatable hopper and hood combination for a shield-type tunneling machine, and a shield-type tunneling machine employing the same.

Referring to FIGS. 1–4, tunneling machine 2 includes cylindrical housing 4 in which concentric cylindrical cutterhead support 6 is mounted. Axle 8 passes through cutterhead support 6 and attaches to hub 10 of rotatable cutterhead 12. Axle 8 causes rotation of cutterhead 12 through interconnection with a power source such as electric or hydraulic motors, in a manner well known in the art. Cutterhead 12 is typically cylindrical and is concentric with housing 4.

Figure 2:
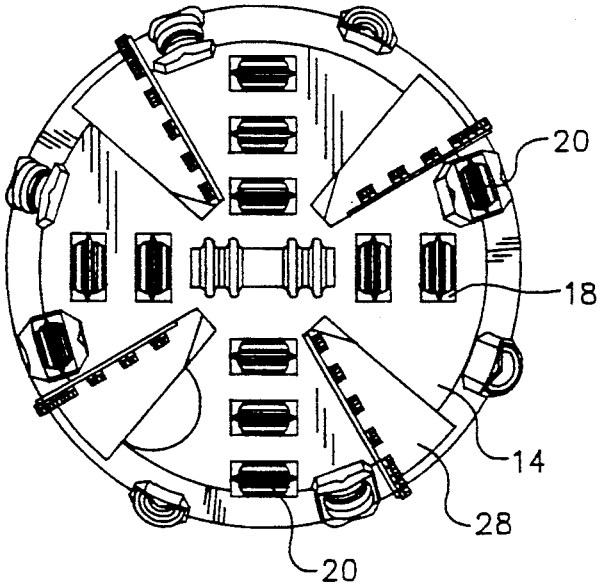
FIG. 2 is a front view of the cutterhead of FIG. 1.
Figure 3:
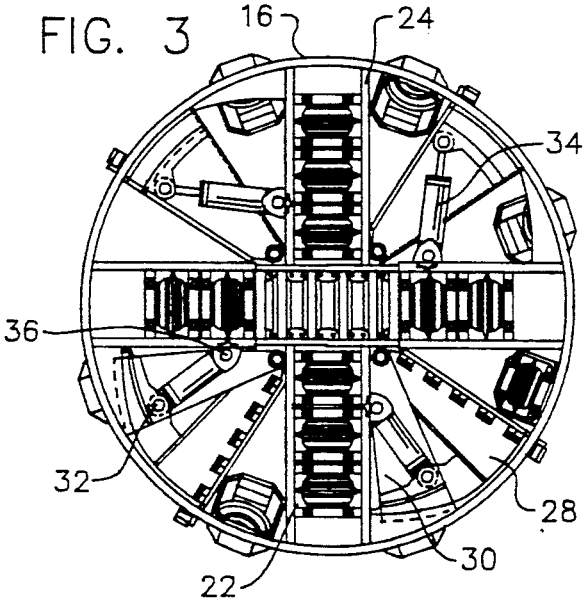
FIG. 3 is a cross-sectional view of the cutterhead taken along line 3—3 of FIG. 1.

Referring to FIGS. 2 and 3, the cutterhead 12 includes a face 14 and circular side wall 16. Face 14 has a plurality of tooth openings 18 through which drag teeth 20 protrude. Teeth 20 are secured to cutterhead 12 by tooth channels 22, formed by parallel bars 24 bisecting the interior 26 of cutterhead 12.

Face 14 has a plurality of radially disposed apertures 28 of variable size. The size of apertures 28 is varied by wedge-shaped doors 30. Each door 30 is radially oriented on face 14 adjacent to each respective aperture 28. Each door 30 is pivotally attached at its wedge point to cutterhead 12 near the center of face 14. A flange 32 attaches an end of hydraulic cylinder 34 to door 30. The other end of hydraulic cylinder 34 is attached to one of parallel bars 24 by flange 36. Doors 30 are thus urged around their pivotal attachment to cutterhead 12 by hydraulic cylinder 34 such that a variable portion of each door 30 overlaps each of apertures 28, thus altering the effective sizes of apertures 28. Variation of the sizes of apertures 28 affects the quantity of earth, loosened by teeth 20, that passes through the apertures 28 and into the interior 26 of cutterhead 12.

Figure 4:
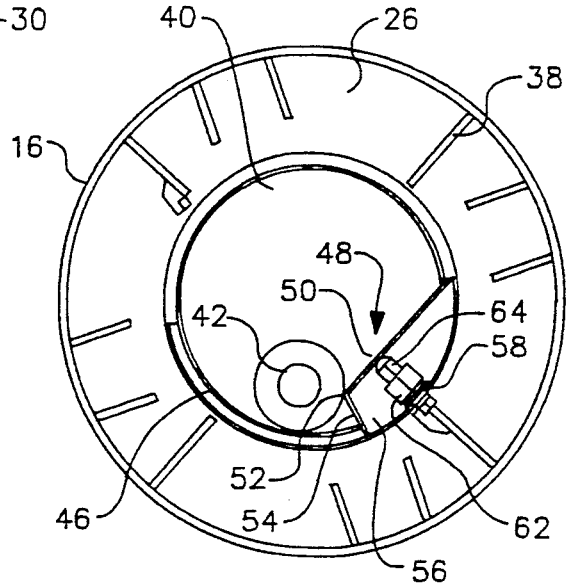
FIG. 4 is a cross-sectional view of the cutterhead and hopper and hood combination taken along line 4—4 of FIG. 1.

Referring now to FIG. 4, on the inner surface of face 14 and sidewall 16, forming interior 26, muck plates 38 are radially disposed. Muck plates 38 do not extend to the center of face 14, but instead terminate prior thereto, thus defining earth collection chamber 40, a cylindrical void concentric with sidewall 16. Earth passing through apertures 28 and entering the interior 26 of cutterhead 12 is lifted, upon rotation of cutterhead 12, by the radially disposed muck plates 38 and is fed to earth conveyor 42 located in the earth collection chamber 40 of interior 26 of cutterhead 12. Earth conveyor 42 is preferably an auger but may also be, for example, an endless conveyor belt. Earth conveyor 42 is powered by a conventional power source known in the art.

Figure 5:
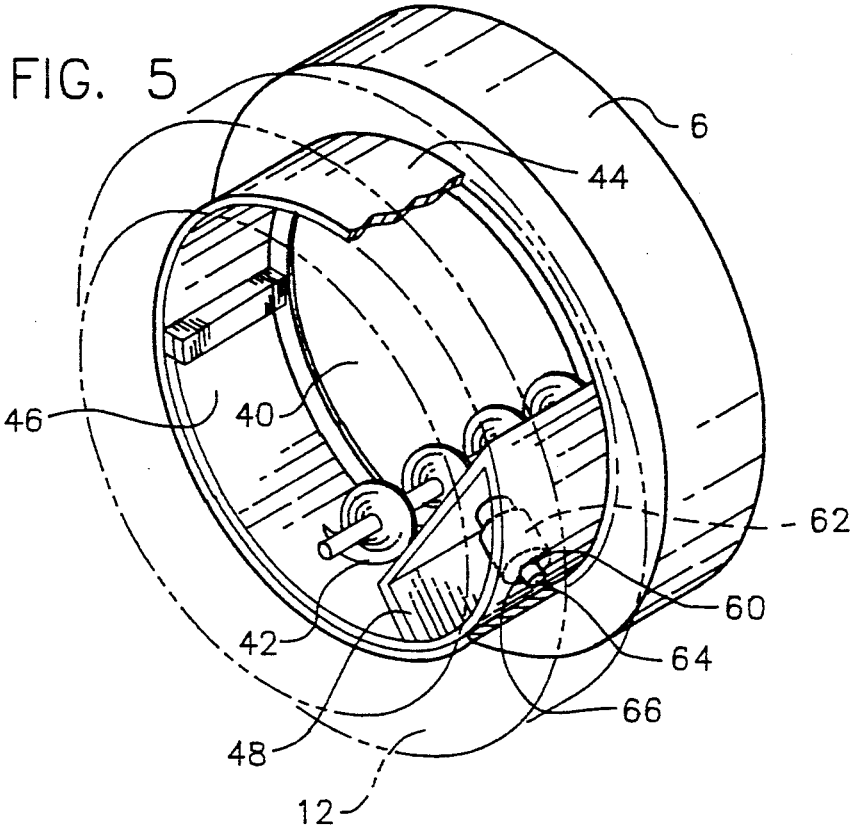
FIG. 5 is a perspective view, with portions broken away, of the hopper and hood combination and cutterhead support of the present invention in its dry muck handling orientation.
Figure 6:
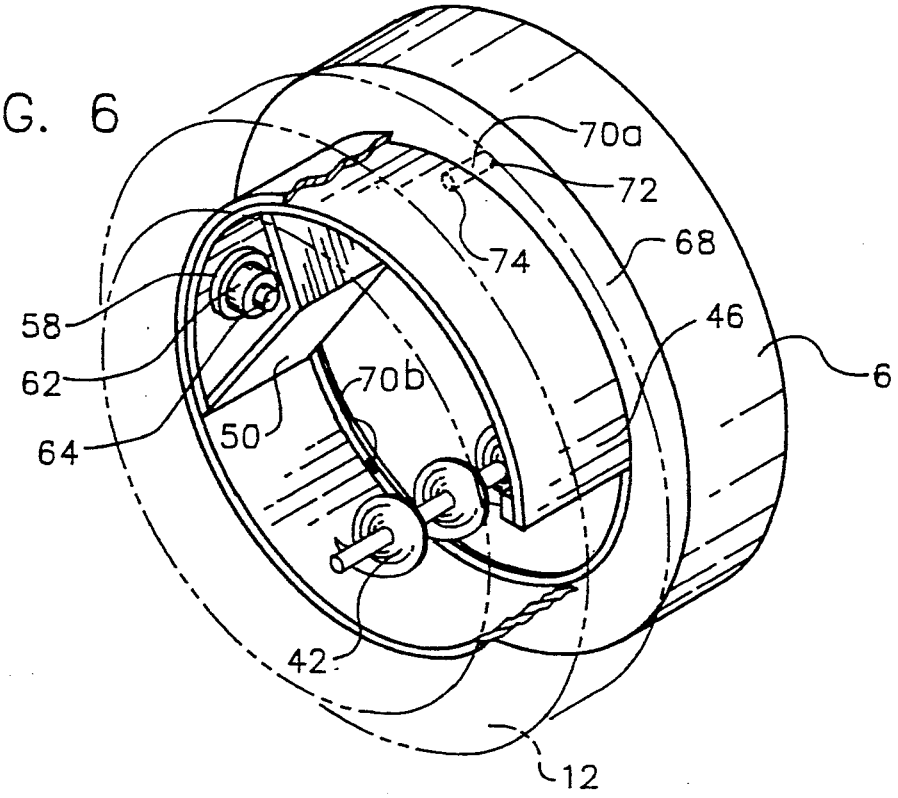
FIG. 6 is a perspective view, with portions broken away, of the hopper and hood combination and cutterhead support of the present invention in its flowing muck handling orientation.

Referring to FIGS. 4–6, a support ring 44 bounds the circumference of earth collection chamber 40 and contains earth conveyor 42. The hopper and hood flow restricting combination of the present invention includes muck collar 46, and a preferably arcuate-shaped collar concentric within, and rotatable about, support ring 44. Muck collar 46, preferably semi-circular in shape, suitably has about 180 degrees in arc.

Muck chute 48 preferably includes a main plate 50 attached to an end of muck collar 46, that spans the width of muck collar 46. Main plate 50 preferably extends towards the interior of muck collar 46 at an angle from horizontal such that, when muck collar 46 occupies the lower hemisphere of support ring 44, the cross-section of main plate 50 is substantially tangential to the circumference of the auger of earth conveyor 42. Main plate 50 has an edge 52 adjacent to earth conveyor 42. Main plate 50 is joined to side plate 54 at edge 52. Side plate 54 is also connected to muck collar 46 such that side plate 54, main plate 50 and a portion of muck collar 46 form a chamber 56.

Described now are the elements that allow muck collar 46 and muck chute 48 to be secured to and repositioned by the cutterhead 12 to and from the dry muck tunneling hopper orientation of FIG. 5 and the flowing muck hood orientation of FIG. 6. This repositioning is accomplished by relative rotation of cutterhead 12, muck collar 46 and muck chute 48 around cutterhead support 6.

Within chamber 56 is cutterhead locking mechanism 58. Cutterhead locking mechanism 58 is preferably a remote control actuated, hydraulically energized apparatus that interengages cutterhead 12 and muck collar 46. Cutterhead lock mechanism 58 includes first muck collar pin orifice 60 through muck collar 46, pin guide 62, a tubular shaped member, and reciprocating pin 64 located in pin guide 62. Cutterhead locking mechanism 58 is designed such that reciprocating pin 64 does not project through first muck collar pin orifice 60 unless cutterhead locking pin mechanism 58 is energized. Aligned in mating orientation with first muck collar pin orifice 60 is cutterhead pin orifice 60 in cutterhead side wall 16. When cutterhead 12 and muck collar 46 are oriented such that first muck collar pin orifice 60 and cutterhead pin orifice 66 are aligned, the actuation of cutterhead locking mechanism 58 projects reciprocating pin 64 through both first muck collar pin orifice 60 and cutterhead pin orifice 66 to secure muck collar 46 and cutterhead 12 during relative rotation of cutterhead 12 around cutterhead support 6.

Described now are the elements that allow securing of muck collar 46 and muck chute 48 to cutterhead support 6. In this orientation, the disclosed apparatus embodying the present invention is in the tunneling mode for either dry muck tunneling with the hopper and hood combination of the present invention in the hopper position or flowing muck tunneling with the hopper and hood combination of the present invention in the hood position. In this tunneling mode, muck collar 46 and muck chute 48 are secured to cutterhead support 6 and cutterhead 12 rotates around these stable elements.

Located in the cutterhead support face 68 adjacent to muck collar 46 are first and second cutterhead support pin orifices **70*a* and 70*b*. First and second cutterhead support pin orifices 70*a* and 70*b* are sized to contain cutterhead support locking pin 72 and are preferably located at points bisecting the face of cutterhead support 6. Preferably, first cutterhead support pin orifice 70*a* is located in the upper hemisphere of face 68 of cutterhead support 6, and second cutterhead support pin orifice 70*b* is located in the lower hemisphere of face 68. Located in the edge of muck collar 46 adjacent to cutterhead support face 68, and alignable with both first and second cutterhead support pin orifices 70*a* and 70*b* is second muck collar pin orifice 74. When either first cutterhead support pin orifice 70*a* or second cutterhead support pin orifice 70*b* are in alignment with second muck collar pin orifice 74, cutterhead support locking pin 72 may be inserted into these orifices to secure muck collar 46 and cutterhead support 6 during relative rotation of cutterhead 12 around cutterhead support 6**.

It is thus readily apparent that through alternative employment of cutterhead locking mechanism 58 and cutterhead support locking pin 72, muck collar 46 (and muck chute 48) can either be secured to cutterhead 12 or to cutterhead support 6 during rotation of cutterhead 12 relative to cutterhead support 6. When muck collar 46 is secured to cutterhead 12 instead of to cutterhead support 6, the mechanism is in the repositioning mode. In the repositioning mode, the radial orientation of the muck collar 46 relative to earth conveyor 42 can be altered between the hopper orientation of FIG. 5, employed for dry muck tunneling, and the hood orientation of FIG. 6, employed for flowing muck tunneling, by relative rotation of muck collar 46 attached to cutterhead 12 around cutterhead support 6. Alternatively, when muck collar 46 is secured to cutterhead support 6 instead of cutterhead 12, the present invention is in the tunneling mode in which the cutterhead rotates around the muck collar 46, muck chute 48, and cutterhead support 6.

To enter the repositioning mode from the tunneling mode, rotation of cutterhead 12 is stopped at an indexed location where the position of cutterhead 12 relative to both cutterhead support 6 and muck collar 46 is such that first muck collar pin orifice 60 and cutterhead pin orifice 66 are in alignment. Cutterhead locking mechanism 58 is then activated, which projects reciprocating pin 64 through both first muck collar pin orifice 60 and cutterhead pin orifice 66 to lock muck collar 46 and cutterhead 12. Next, cutterhead locking pin 72 is removed from second muck collar pin orifice 74 and the one of first cutterhead support pin orifice 70*a* and second cutterhead support pin orifice 70*b* in alignment with second muck collar pin orifice 74 (e.g., orifice 70*a*). This allows rotation of muck collar 46 relative to cutterhead support 6. Cutterhead 12, locked with muck collar 46, is then rotated around cutterhead support 6 so that muck collar 46 is approximately 180 degrees from its previous location relative to earth conveyor 42, and second muck collar pin orifice 74 is in alignment with the other of first cutterhead support pin orifice 70*a* and second cutterhead support pin orifice 70*b* (e.g., orifice 70*b*). To enter the tunneling mode from the repositioning mode, cutterhead locking pin 72 is inserted through second muck collar pin orifice 74 and the one of first and second cutterhead support pin orifice 70*a* and 70*b* with which it is now aligned (e.g., orifice 70*b*). Muck collar 46 and muck chute 48 are now locked onto cutterhead support 6. Cutterhead locking mechanism 58 is then deactivated, resulting in withdrawal of reciprocating pin 64 from cutterhead pin orifice 66 and first muck collar pin orifice 60. Muck collar 46 and muck chute 48 are now unlocked from cutterhead 12 and the mechanism is configured for tunneling.

Referring to FIGS. 5 and 6, the dry muck tunneling hopper orientation and the flowing muck tunneling hood orientation of the present invention are now detailed. As shown in FIG. 5, during dry muck tunneling, muck collar 46 is located in the lower hemisphere of support ring 44 and muck chute 48 is located adjacent to earth conveyor 42. As cutterhead 12 is rotated relative to cutterhead support 6, teeth 20 loosen earth from the face of the tunnel in front of cutterhead 12. The loosened earth passes through apertures 28 and is collected by muck plates 38 in interior 26 of cutterhead 12. Each of muck plates 38 dumps earth into earth collecting chamber 40 of cutterhead 12 when the muck plate 38 reaches a point above muck chute 48 and earth conveyor 42. The earth dropped by muck plates 38 into earth collecting chamber 40 falls onto main plate 50 which channels the earth towards earth conveyor 42. The angled orientation of main plate 50 thus augments the gravitational feed of the earth into earth conveyor 42.

Referring to FIG. 6, the flowing muck tunneling hood orientation of the present invention, muck collar 46, is located in the upper hemisphere of support ring 44 and muck chute 48 is remote from earth conveyor 42. During flowing muck tunneling, the tunnel face can collapse when the earth flow from the tunnel face is too rapid. The upper tunnel face is the area in which overexcavation is most likely to occur, and cause subsidence if not controlled. Muck chute 48 aids in restricting flow of the unstable earth from the upper tunnel face into earth collection chamber 42 due to its orientation in the upper hemisphere of support ring 44, and thus by back pressure tends to support the work face from collapse.

While a particular embodiment of the present invention has been described in some detail herein, changes and modifications may be made without departing from the spirit and scope of the invention as defined by the following claims.

I claim:

1. A hopper and hood combination for a tunneling machine having a rotatable cutterhead, an earth conveyor means within the cutterhead, and a cutterhead support, said hopper and hood combination comprising:

a muck collar means following and projecting into the rotatable cutterhead; and a muck chute means on said muck collar, said muck collar means and said muck chute means rotatable between a hopper position, where said muck collar means and said muck chute means are adjacent to the earth conveyor means to feed earth collected in the cutterhead to the earth conveyor means, and a hood position, where said muck collar means and said muck chute means are remote from the earth conveyor means, to restrict earth flow to the earth conveyor means.

2. The hopper and hood combination of claim 1 wherein said muck collar means is arcuate-shaped and is coaxially oriented with the cutterhead.

3. The hopper and hood combination of claim 2 wherein said muck chute means includes a plate on an end of said muck collar means, with said plate pitched at an angle from horizontal and having an edge adjacent to the earth conveyor means when said hopper and hood combination is in the hopper position

4. The hopper and hood combination of claim 3 wherein the earth conveyor means is an auger and said plate of said muck chute means has a cross-section tangential to the circumference of the auger.

5. The hopper and hood combination of claim 1 wherein said hopper and hood combination is locked to the cutterhead support in a tunneling mode and is locked to the cutterhead in a repositioning mode for movement of said hopper and hood combination between the hopper position and the hood position responsive to rotation of the cutterhead relative to the cutterhead support

6. The hopper and hood combination of claim 5 further comprising:

a first locking means for securing said hopper and hood combination to the cutterhead support in the tunneling mode; and a second locking means for securing said hopper and hood combination to the cutterhead in the repositioning mode.

7. The hopper and hood combination of claim 6 wherein said second locking means is a locking pin actuated by remote control.

8. A hopper and hood combination for a tunneling machine having a rotatable cutterhead, an earth conveyor auger within the cutterhead, and a cutterhead support, said hopper and hood combination comprising:

an arcuate-shaped muck collar on the cutterhead support, said muck collar coaxially oriented with and projecting into the cutterhead;

a muck chute comprising a plate on an end of said muck collar, said plate being pitched at an angle from horizontal, said plate having an edge adjacent to the earth conveyor auger and having a cross-section tangential to the circumference of the earth conveyor auger when said muck collar and said muck chute are in a hopper orientation to feed earth collected in the cutterhead to the earth conveyor auger, said muck collar and said muck chute being rotatable to a hood position where said muck collar and said muck chute are remote from the earth conveyor auger to restrict earth flow to the earth conveyor auger;

a first locking pin for securing said hopper and hood combination to the cutterhead support in a tunneling mode; and a second locking pin for securing said hopper and hood combination to the cutterhead in a repositioning mode for movement of said hopper and hood combination between the hopper position and the hood position by rotation of the cutterhead relative to the cutterhead support.

9. An earth tunneling apparatus comprising:

a cutterhead support having an opening;

a cutterhead rotatably mounted on said cutterhead support;

an earth conveyor means through said opening of said cutterhead support and within said cutterhead;

a muck collar means projecting into said cutterhead;

a muck chute means on said muck collar means, said muck collar means and said muck chute means being rotatable to a hopper position where said muck collar means and said muck chute means are adjacent to said earth conveyor means to feed earth collected in said cutterhead to the earth conveyor means, and being rotatable to a hood position where said muck collar means and said muck chute means are remote from said earth conveyor means to restrict earth flow to said earth conveyor means.

10. The apparatus of claim 9 wherein said muck collar means is arcuate-shaped and is axially oriented with said cutterhead.

11. The apparatus of claim 10 wherein said muck chute means includes a plate on an end of said muck collar means, said plate being pitched at an angle from horizontal and having an edge adjacent to said earth conveyor means when said hopper and hood combination is in the hopper position.

12. The apparatus of claim 11 wherein said earth conveyor means is an auger and said plate of said muck chute means has a cross-section tangential to the circumference of said auger.

13. The apparatus of claim 9 wherein said muck collar means and said muck chute means are non-rotatively interconnected to said cutterhead support when in a tunneling mode, and are interconnected to said cutterhead in a repositioning mode for movement of said muck collar means and said muck chute means between the hopper position and the hood position by rotation of said cutterhead relative to said cutterhead support.

14. The apparatus of claim 13 further comprising:

a first locking means for securing said muck collar means and said muck chute means to said cutterhead support in the tunneling mode; and a second locking means for securing said muck collar means and said muck chute means to said cutterhead in the repositioning mode.

15. The hopper and hood combination of claim 14 wherein said second locking means is a locking pin actuated by remote control.

16. An earth tunneling apparatus comprising:

a cutterhead support having an opening;

a cutterhead rotatably mounted on said cutterhead support, said cutterhead having an interior earth collecting chamber;

an earth conveyor auger extending through said opening of said cutterhead support and within said cutterhead interior earth collecting chamber;

an arcuate-shaped muck collar on said cutterhead support, said muck collar being axially oriented with said cutterhead and projecting into said interior earth collecting chamber of said cutterhead;

a muck chute comprising a plate on an end of said muck collar, said plate being pitched at an angle from horizontal, said plate having an edge adjacent to said earth conveyor auger and having a cross-section tangential to the circumference of said earth conveyor auger when said muck collar and said muck chute are in a hopper orientation to feed earth collected in said interior chamber of said cutterhead to said conveyor auger, said muck collar and said muck chute being rotatable to a hood position where said muck collar and said muck chute are remote from said earth conveyor auger to restrict earth flow to said earth conveyor auger;

a first locking pin for securing said muck collar and said muck chute to said cutterhead support in a tunneling mode; and a second locking pin for securing said muck collar and said muck chute to said cutterhead in a repositioning mode for movement of said muck collar and said muck chute between the hopper position and the hood position by rotation of said cutterhead relative to said cutterhead support.

* * * * *